US005251738A

United States Patent [19]

Dabrowski

[11] Patent Number: 5,251,738

[45] Date of Patent: Oct. 12, 1993

[54] CURRENCY HANDLING SYSTEM

[75] Inventor: Stanley P. Dabrowski, Las Vegas, Nev.

[73] Assignee: Sevens Unlimited, Inc., Las Vegas, Nev.

[21] Appl. No.: 855,427

[22] Filed: Mar. 23, 1992

Related U.S. Application Data

[63] Continuation-in-part of Ser. No. 645,966, Jan. 23, 1991, Pat. No. 5,098,339, and a continuation-in-part of Ser. No. 721,668, Jun. 26, 1991, Pat. No. Des. 335,149.

[51] Int. Cl.[5] ..... G07F 7/04; B65H 29/46

[52] U.S. Cl. ..... 194/206; 271/181

[58] Field of Search ..... 194/206, 207, 350; 271/177, 180, 181; 100/289

[56] References Cited

U.S. PATENT DOCUMENTS

| | | | |
|---|---|---|---|
| 3,882,770 | 5/1975 | Bleasdale | 100/289 X |
| 4,011,931 | 3/1977 | Wyckoff | 194/206 |
| 4,332,348 | 6/1982 | Nordin | 271/180 X |
| 4,834,230 | 5/1989 | Kondo et al. | 194/206 |
| 4,966,304 | 10/1990 | Kelly | 194/350 X |

FOREIGN PATENT DOCUMENTS

| | | | |
|---|---|---|---|
| 2-93890 | 4/1990 | Japan | 194/206 |

OTHER PUBLICATIONS

Lucky Changer, Ardac Incorporated, two page brochure.

Mister Change, Ardac Incorporated, four photographs.

*Primary Examiner*—F. J. Bartuska

*Attorney, Agent, or Firm*—John Edward Roethel

[57] ABSTRACT

A currency handling system comprises a stand alone apparatus that includes a currency acceptor, a currency stacker with a separate, removable currency cassette and a coin feeding device. The currency acceptor is mounted on the inside of a hinged door to allow easy access for maintenance. The currency acceptor is positioned in operable relationship to the currency stacker so that currency exiting the currency acceptor feeds directly into stacking position. A currency positioning plate is connected to a drive motor and the currency is pushed by the positioning plate into the currency cassette mounted in the currency stacker. The currency cassette is a separate removable component that includes a biasing element. When the currency cassette is full and this condition is detected by the sensors, the currency cassette is simply replaced in toto, and an empty currency cassette is inserted into the currency stacker. The currency handling system also includes a coin feeding device that dispenses loose coin into a coin tray located on the front of the apparatus for access by the user. An alternate version of the present invention eliminates the coin feeding device. Instead the currency acceptor is electronically connected to an adjacent gaming device and a signal is sent to the credit meter of the gaming device allocating user credits on the credit meter of the gaming device corresponding to the value of the currency inserted by the user.

19 Claims, 9 Drawing Sheets

CURRENCY HANDLING SYSTEM

CROSS-REFERENCE TO RELATED APPLICATIONS

This application is a Continuation-in-Part of application Ser. No. 07/645,966, filed Jan. 23, 1991, entitled "Coin Feeding Device", now U.S. Pat. No. 5,098,339; and is also a Continuation-in-Part of application Ser. No. 07/721,668, filed Jun. 26, 1991, entitled "Currency Acceptor and Coin Dispensing Apparatus."

This invention relates to a currency handling system and more particularly to a currency handling system that includes a currency acceptor, a currency stacker and a separate currency cassette for storing the currency, the currency cassette being removable from the remainder of the currency stacker. Additionally, the currency acceptor can be integrated into an apparatus that includes a coin feeding device to dispense coins directly to the user.

BACKGROUND OF THE INVENTION

There are many devices that are operated by means of inserting money. A typical vending machine requires the patron to insert one or more coins in order to be able to receive a soft drink, a postage stamp, a subway token or some other item of value. Many gaming devices also require the insertion of coins in order to operate.

As automation increases, it has become necessary and desirable to provide vending and gaming machines with the ability to accept paper money. The insertion of paper money requires a currency acceptor/validator to verify that the paper money is legitimate as well as a currency storage compartment to hold the paper money until it is removed from the device.

In a conventional currency stacker, the currency storage compartment is an integral part of the device. In order to remove stored paper currency, the entire currency stacker must be separated from the remainder of the vending or gaming machine and replaced with another currency stacker while the filled currency stacker is taken to another location where the 14 paper currency inside the storage compartment is counted and otherwise processed. Alternatively, the paper currency is simply removed by hand from the storage compartment which minimizes the ability to maintain accounting control over the contents of the currency storage compartment.

In gaming related applications, currency handling systems have been proposed in many different forms. There are stand alone units which receive currency and dispense rolled coin. A system known as the "Lucky Changer TM" has been distributed by the Ardac Incorporated. The "Lucky Changer TM" accepts currency and dispenses loose coins from an internal hopper into a coin tray. The "Lucky Changer TM" is approximately the same size as a gaming device and takes up space that could otherwise be used for gaming devices.

Ardac Incorporated also distributes a smaller change device known as "Mister Change TM". This device is sized to fit in between two adjacent gaming devices, includes a currency acceptor, a currency stacker with a cassette, a coin feeding device and an external coin tray.

It is an object of the present invention to provide a currency handling system that efficiently and reliably accepts and validates various denominations of currency, stacks the currency for later retrieval and dispenses loose coin for access by the user.

It is a feature of the present invention to provide a currency handling system that includes a currency acceptor, a currency stacker that interacts with the currency acceptor to receive and stack currency, a currency cassette removably positioned in the currency stacker into which the currency is stacked and a coin feeding device integrated with the currency acceptor and the currency stacker into the currency handling system to dispense loose coins for access by the user into a coin tray.

It is an advantage of the present invention that currency can be accepted, validated, stacked for retrieval and loose coin dispensed to a user using an efficient and reliable apparatus.

It is a further object of the present invention to provide a currency handling system that efficiently and reliably accepts and validates various denominations of currency, stacks the currency for later retrieval and interfaces with a gaming device to allocate credits to the credit meter of the gaming device to allow the user to operate the gaming device.

It is a further feature of the present invention to provide a currency handling system that includes a currency acceptor, a currency stacker that interacts with the currency acceptor to receive and stack currency, a currency cassette removably positioned in the currency stacker into which the currency is stacked and an electronic interface to the credit meter of the gaming device.

It is a further advantage of the present invention that currency can be accepted, validated, stacked for retrieval and credits allocated to the credit meter of the gaming device using an efficient and reliable apparatus.

It is a further object of the present invention to provide a currency stacker that receives currency from a currency acceptor and stacks the currency in an efficient and compact manner into a separately removable currency cassette.

It is a further feature of the present invention to provide a currency stacker positioned adjacent the currency acceptor, the currency stacker including a positioning plate that stacks the received currency into a separate removable currency cassette mounted in the currency stacker.

It is a further advantage of the present invention that currency fed into the currency acceptor by a user is efficiently and compactly stacked into a separate, removable currency cassette.

It is a further object of the present invention to provide a currency cassette that interfits into a currency stacker so that removal of paper currency can be effected without the necessity of removing the entire currency stacker from the vending or gaming equipment.

It is a further feature of the present invention to provide a currency cassette that is completely removable from the rest of the currency stacker so that an empty currency cassette can be substituted for a full currency cassette without replacing the entire currency stacker.

It is a further advantage of the present invention that when the currency cassette is full, the currency cassette can be removed from the currency stacker and replaced with an empty currency cassette without the necessity of removing the entire currency stacker from the currency handling system.

SUMMARY OF THE INVENTION

A currency handling system comprises a stand alone apparatus that includes a currency acceptor, a currency stacker with a separate, removable currency cassette and a coin feeding device. The currency acceptor is mounted on the inside of a hinged door on the front of the apparatus to allow easy access for maintenance. The currency acceptor is positioned in operable relationship to the currency stacker so that currency exiting the currency acceptor feeds directly into stacking position. A currency positioning plate is connected to a drive motor and the currency is pushed by the positioning plate into the currency cassette mounted in the currency stacker. The currency cassette is a separate removable component that includes a hinged lockable lid, a pressure plate and a biasing element. When the currency cassette is full and this condition is detected by the sensors, the currency cassette is simply replaced in toto, and an empty currency cassette is inserted into the currency stacker. The currency handling system also includes a coin feeding device that dispenses loose coin into a coin tray located on the front of the apparatus for access by the user.

An alternate version of the present invention eliminates the coin feeding device. Instead the currency acceptor is electronically connected to an adjacent gaming device and a signal is sent to the credit meter of the gaming device allocating user credits on the credit meter of the gaming device corresponding to the value of the currency inserted by the user.

DETAILED DESCRIPTION OF THE PREFERRED EMBODIMENTS

Figure 1:
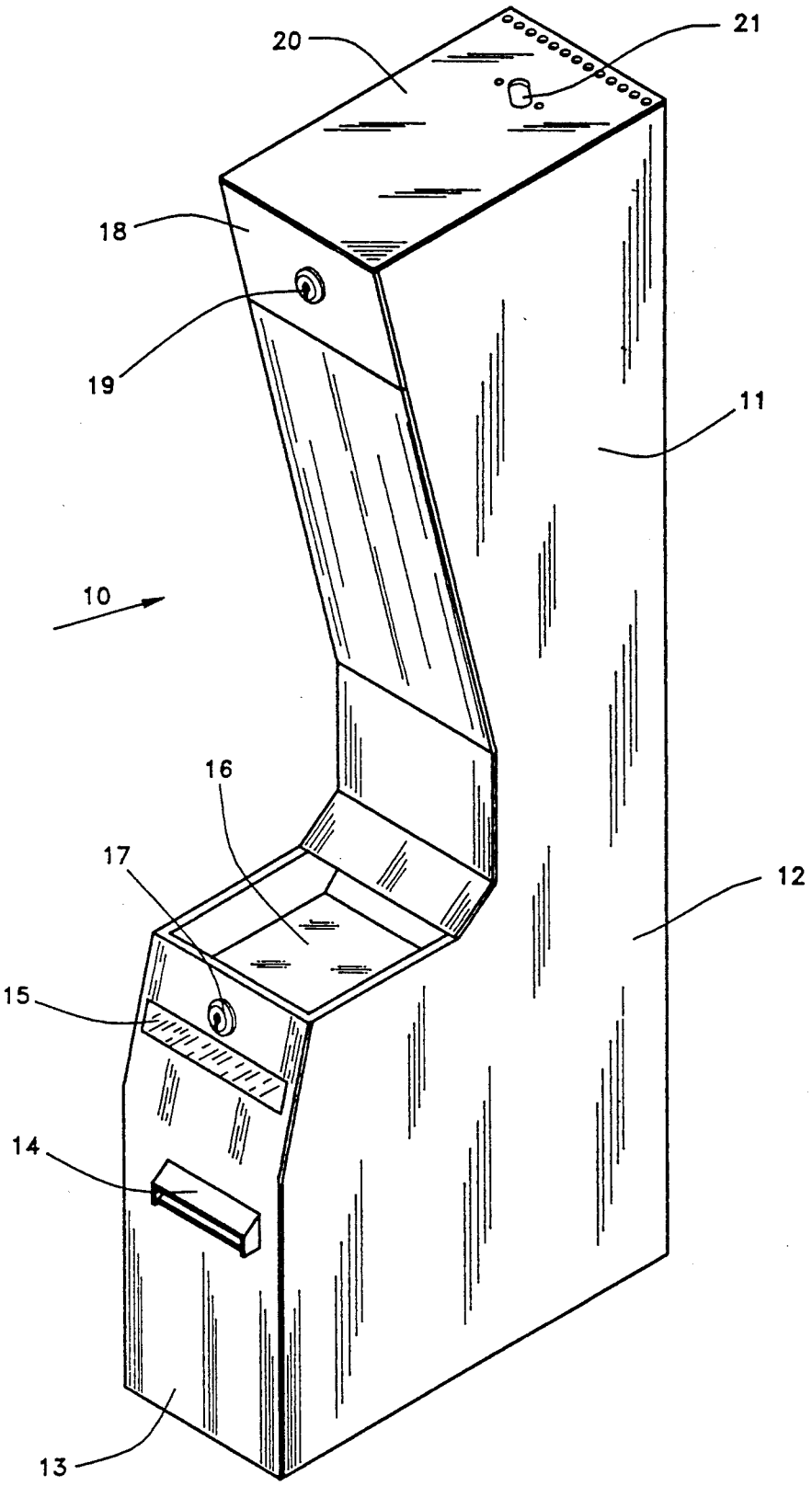
FIG. 1 shows an overall perspective view of the currency handling system of the present invention.

The currency handling system of the present invention is shown generally at 10 in FIG. 1. The currency handling system 10 includes an upper section 11 that contains the coin feeding device and a lower section 12 which contains the currency acceptor, the currency stacker and the currency cassette. The upper section 11 and the lower section 12 may be joined integrally or may be two separate assemblies as desired.

The front of the lower section 12 is provided with a stacker access door 13 that also includes a currency slot 14, a digital display 15 and a lock 17. The forward portion of the top of the lower section 12 is also provided with a coin tray 16 that interacts with the coin feeding device in the upper section 11.

The upper section 11 has a front portion that includes a coin feeding device access door 18 and a lock 19. The upper section 11 is closed off at its upper end by a top 20 that also includes a candle mount 21. The candle mount 21 provides the positioning location for a light system (known as a "candle") used in gaming establishments to alert personnel that service or attention is needed on that piece of equipment at that location.

Figure 2:
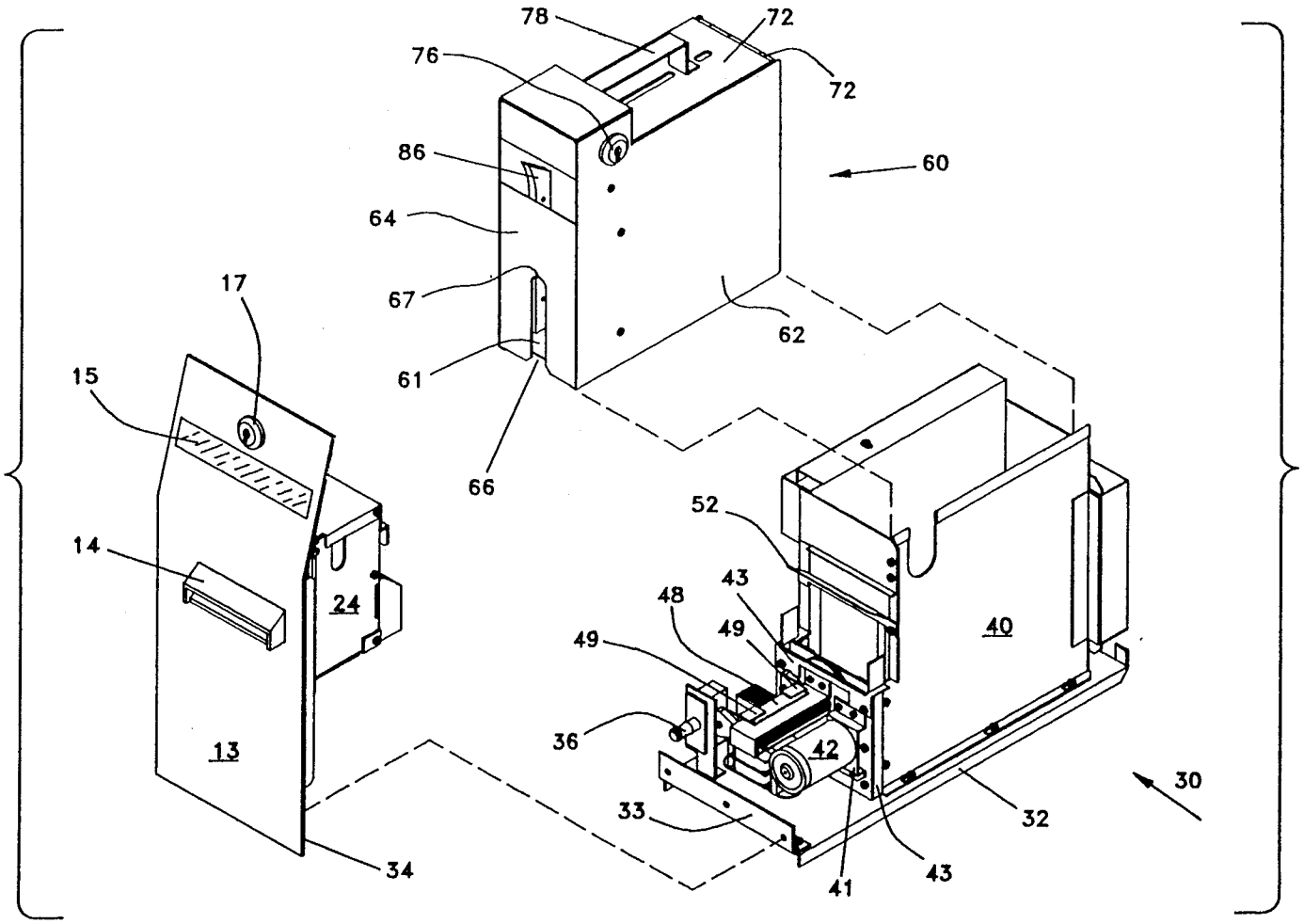
FIG. 2 shows an exploded view in perspective of the currency stacker of the present invention including the stacker access door, the currency acceptor and the currency cassette.
Figure 3:
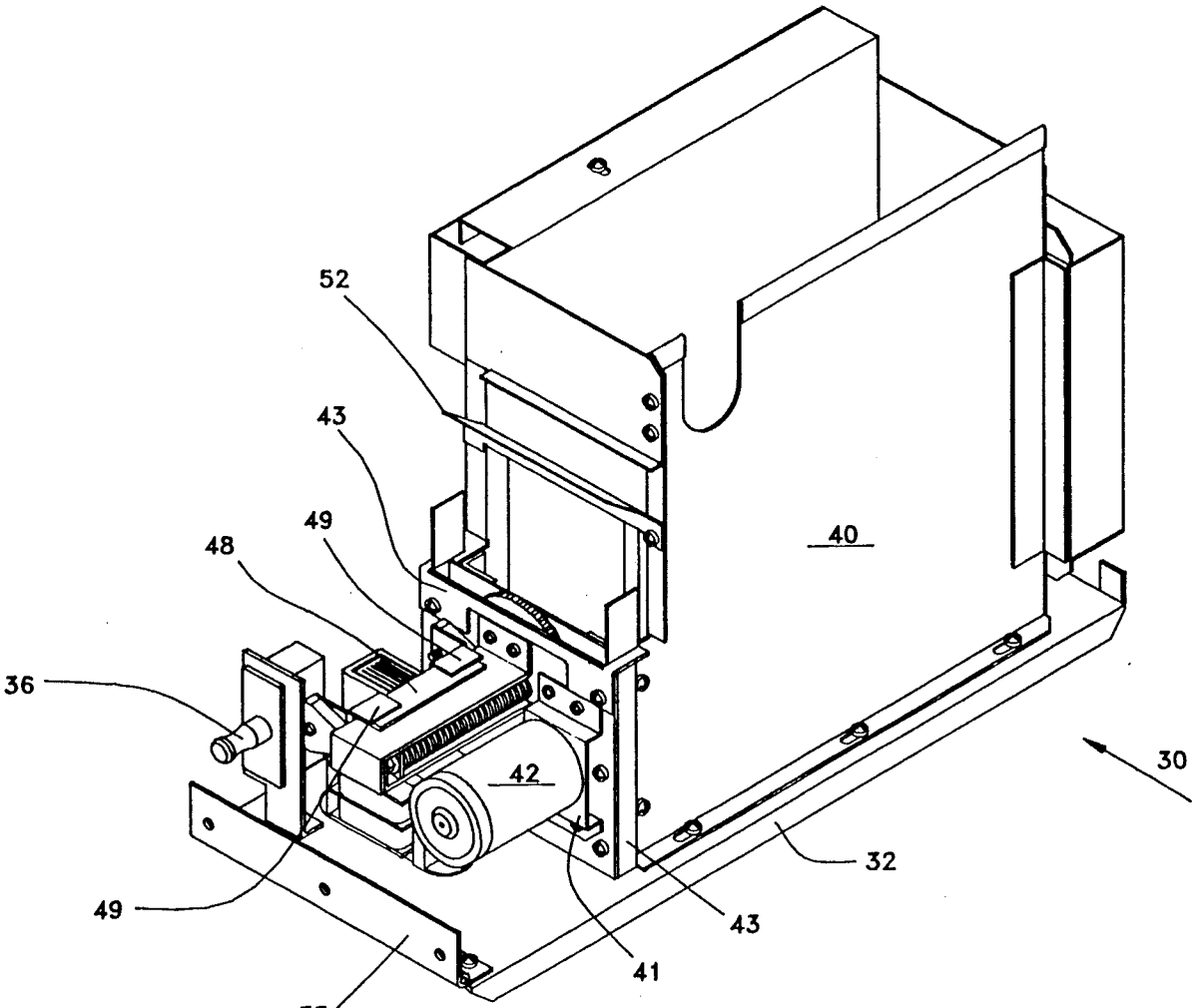
FIG. 3 shows a detailed perspective view of the currency stacker of the present invention without the currency cassette mounted therein.

The currency stacking subassembly of the present invention that is contained in the lower section 12 of the currency handling system 10 is shown in FIG. 2. The currency stacking subassembly includes the currency acceptor 24, the currency stacker 30 and the currency cassette 60.

The stacker access door 13 includes a currency slot 14, the backside of which communicates with a currency acceptor 24 mounted on the back of the stacker access door 13. The currency slot 14 is typically the width of conventional paper money, such a U.S. currency. The currency acceptor 24 can be any conventional currency acceptor that validates and determines whether paper currency inserted into the currency handling system 10 is legitimate. A preferred currency acceptor is Model No. DBV-135, distributed by Tekbilt Corporation, Huntingdon Valley, Pa.

Also included in the stacker access door 13 is a digital display 15, which may be any conventional digital display such as an LED or LCD display, which is programmed by means of a conventional electronic circuitry to display messages to the user of the currency handling system 10. The typical messages would alert the user to the denominations of currency that can be accepted by the currency handling system 10 and also to alert the user when a particular denomination has been inserted and accepted by the currency handling system 10. The digital display 15 can also be used to send messages to the maintenance personnel indicating the currency cassette 60 is full or that the door 13 is open. The stacker access door 13 also includes any conventional lock 17 to secure the stacker access door 13 in a closed and locked position.

The currency stacker 30 has a base plate 32 that serves as the floor of the currency stacker 30. At the front end of the base plate 32 there is provided a hinge 33 that interacts with the door bottom 34 of the stacker access door 13. This hinge 33 allows the stacker access door 13 to be swung open to allow maintenance or service access to the currency stacker 30.

The base plate 32 of the currency stacker 30 is designed to slidably rest on guides (not shown) mounted on the inside floor of the lower section 12. This allows the currency stacker in its entirety to slide forward when the access door 13 is opened. This forward movement of the currency stacker 30 permits access to the currency cassette 60 so that it may be removed when it is full and replaced with an empty currency cassette. Also attached to the base plate is a door switch 36 so that when the door 13 is open, a signal can be sent to the digital display 15.

The currency stacker 30 includes a cassette sleeve 40 mounted on the base plate 32. The cassette sleeve 40 is sized to slidably receive the currency cassette 60. The cassette sleeve 40 has mounted on one end thereof a drive motor housing 43. The drive motor housing 43 is a generally rectangular frame fastened by means of bolts or other suitable fasteners to the body of the cassette sleeve 40. A drive motor 42 is also attached to the drive motor housing 43 by means of a drive motor bracket 41. The drive shaft 53 of the drive motor 42 connects to the drive wheel 45 by means of a gear 55 and effects the rotational movement of the drive wheel 45.

A sensing unit 48 is also mounted on the drive motor housing 43 and is electronically connected to the drive motor 42. In the preferred embodiment, a pair of Hall effect sensors 49R and 49F are used to detect the position of a magnet 51 attached to the archimedean screw 44. The position of the magnet 51 relative to the rear sensor 49R and the front sensor 49F corresponds to the position of the positioning plate 50 in either the receiving or the stacking position, respectively, as will be explained. Instead of using a magnet with Hall effect sensors, an optical or other appropriate sensing device could also be used.

When the currency acceptor 24 accepts paper currency inserted therein, a signal is sent from the currency acceptor 24 through the electronic controls to the drive motor 42 to effect storage of the paper currency in the currency cassette 60 and the storage of the paper currency is achieved by movement of the positioning plate 50.

Figure 6:
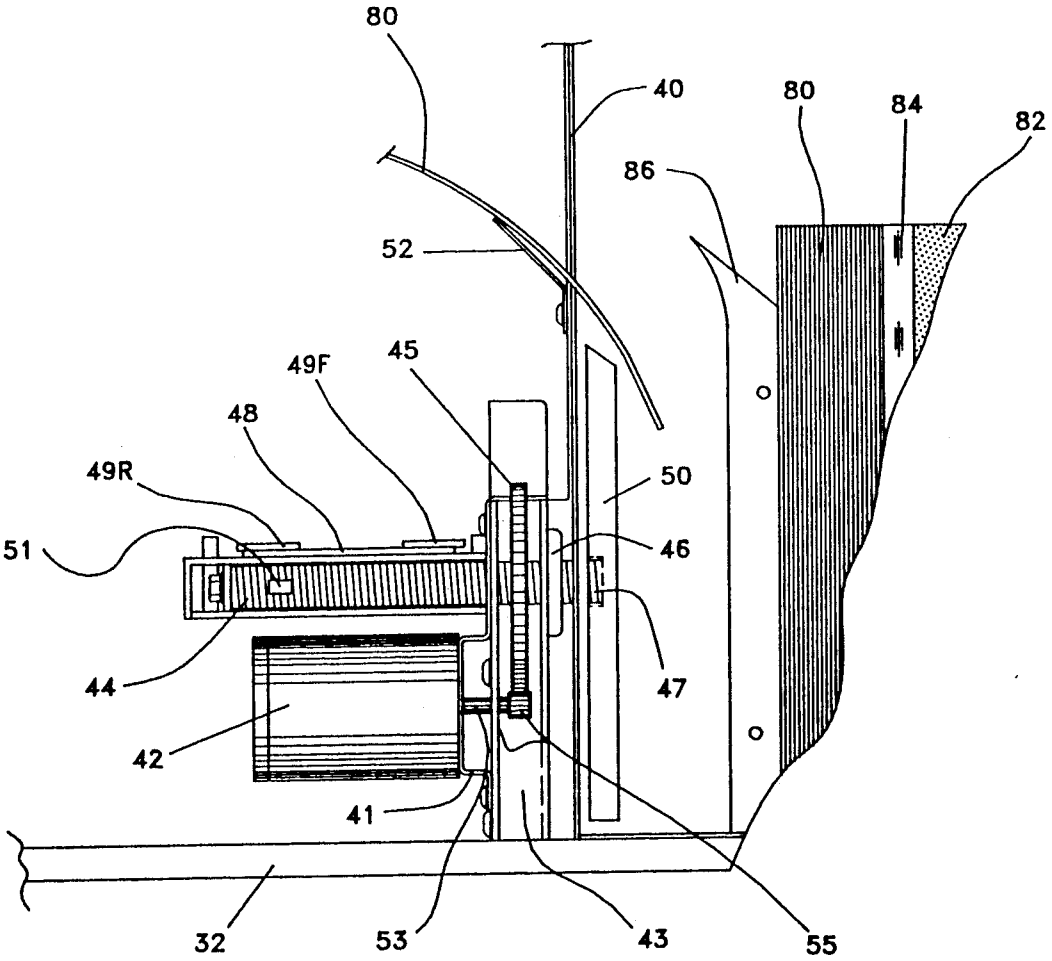
FIG. 6 shows the currency stacker of the present invention with the currency positioning plate in a position prior to the currency being stacked in the currency cassette.

The positioning plate 50 is connected to one end of the archimedean screw 44 and is located on the interior of the cassette sleeve 40 behind the currency guide slot 52 (see FIG. 6). The positioning plate 50 is used to position and stack the paper currency in the currency cassette 60. The archimedean screw 44 passes through the center of the drive wheel 45 which engages the pitch of the archimedean screw 44. Rotation of the drive wheel 45 will cause reciprocal movement of the archimedean screw 44 which in turns effects reciprocal movement of the positioning plate 50 on the interior of the cassette sleeve 40 between a paper currency receiving position shown in FIG. 6 and a paper currency stacking position shown in FIG. 7.

Figure 4:
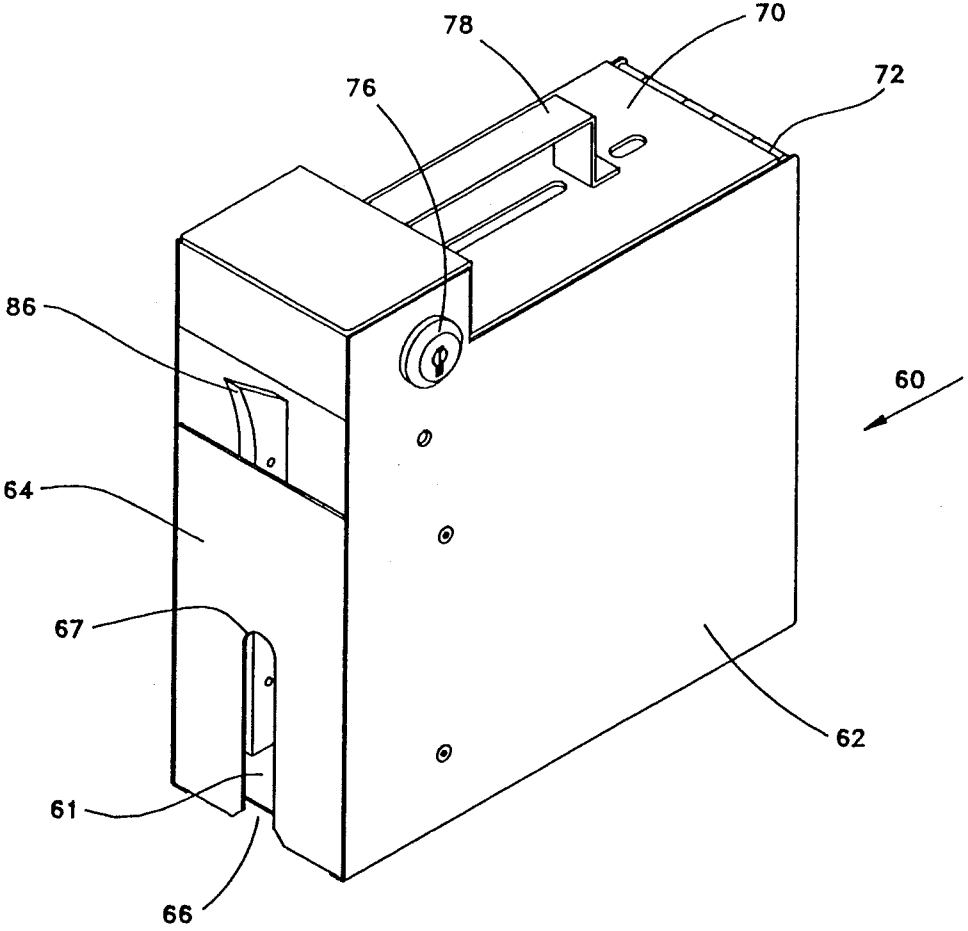
FIG. 4 shows a perspective view of the currency cassette of the present invention in the closed position.
Figure 5:
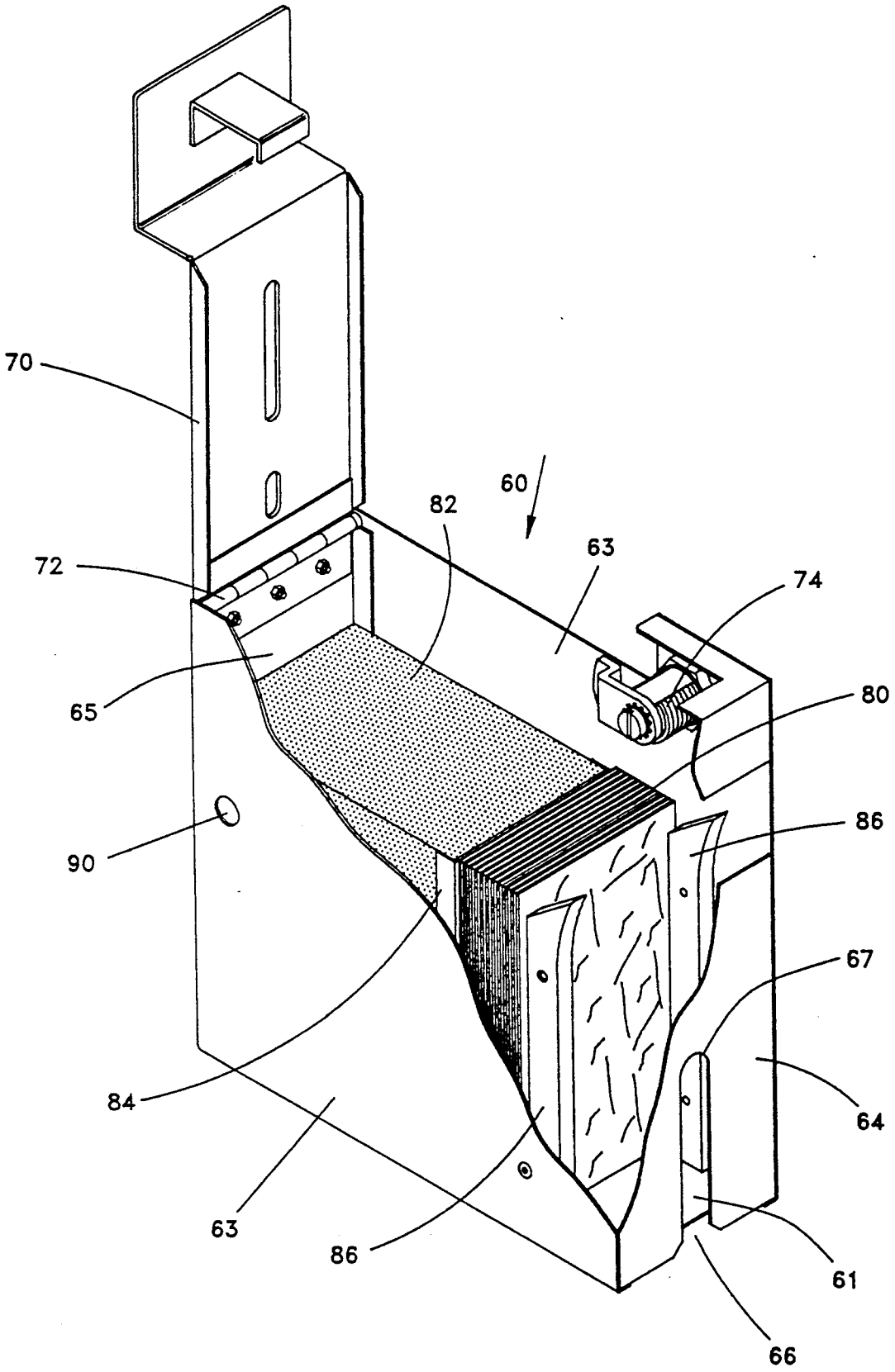
FIG. 5 shows a perspective view of the currency cassette of the present invention in the open position.

The currency cassette of the present invention is shown generally at 60 in FIGS. 2, 4 and 5. FIG. 4 shows the currency cassette 60 in its closed and locked position. The currency cassette 60 is a generally rectangular assembly having a floor 61, right side wall 62, a left side wall 63, a front wall 64 and a back wall 65. The top of the currency cassette 60 is closed by means of a lid 70. The lid 70 interacts with a conventional lock 74 having a typical key port 76 mounted in the right side wall 62. The lid 70 also has a handle 78 to accommodate ease of removal of the currency cassette 60 from the cassette sleeve 40.

The front wall 64 includes a generally U-shaped archimedean screw slot 67 so that the currency cassette 60 can be inserted into the cassette sleeve 40 and provide clearance for the archimedean screw 44. The front end of the floor 61 of the currency cassette 60 is separated slightly from the bottom of the front wall 64. This creates a positioning plate slot 66 so that the positioning plate 50 can be accommodated inside the front wall 64 of the currency cassette 60 when the currency cassette 60 is lowered into the cassette sleeve 40.

FIG. 5 shows the currency cassette 60 in its open position when the lid 70 has been unlocked. The lid 70 is pivotally mounted to the rest of the currency cassette 60 by means of a conventional hinge 72. Inside the currency cassette 60 there is provided a foam biasing member 82 secured to the inside of the back wall 65 of the currency cassette 60 thereof by any appropriate means such a glue. Alternatively, a spring member could be used. The opposite free end of the foam biasing member 82 is covered by a pressure plate 84 made of metal or other suitable rigid material. Adjacent the inside of the front wall 64 of the currency cassette 60 are a pair of upright vertical restraining members 86 which function to retain the currency 80 in an upright position next to the pressure plate 84 on the foam biasing member 82 as the currency 80 is stacked into the currency cassette 60.

A sensor aperture 90 is provided at an appropriate location on one of the side walls, such as the left side wall 63 of the currency cassette 60. The sensor aperture 90 is located opposite a sensor (not shown) to detect when the currency cassette 60 is full of currency. When the sensor detects this full condition of the positioning plate 50, a signal can be sent through the electronic control system to alert the establishment that it is time to change to an empty currency cassette 60. For example, the candle on the top of the currency handling system 10 can be illuminated when the currency cassette 60 is full and a cassette is full message can be displayed on the digital display 15.

Prior to the currency 80 being fed into the currency handling system 10, the positioning plate 50 is located in its "receiving" position shown in FIG. 6. In the receiving position of the positioning plate 50, a space is provided in front of the restraining members 86 in the currency cassette 60 to receive the paper currency to be stacked. The archimedean screw 44 has been rotated by the drive motor 42 and the drive wheel 45 so that the magnet 51 is positioned adjacent the rear sensor 49R.

When the currency handling system of the present invention is placed in use, paper money currency, preferably in the form of U.S. paper currency such as $1, $5, $10, $20 and $50 bills, is inserted by the user one at a time into the currency slot 14. When the currency acceptor 24 senses the presence of a paper currency, the currency acceptor 24 draws the paper currency into the currency acceptor 24 where it is validated in a conventional manner. If the paper currency validates as legitimate, a message can be sent to the user via the digital display 15.

The currency acceptor 24 then feeds the currency 80 for stacking. As the paper currency is fed for stacking, the currency acceptor 24 sends a signal to the drive motor 42 which activates the drive wheel 45 which, in turn, activates the archimedean screw 44 to cause the archimedean screw 44 to traverse horizontally relative to the fixed bolt 46 which in turn causes the positioning plate 50, connected to the end 47 of the archimedean screw 44, to travel to its "stacking" position shown in FIG. 7 to stack the currency 80.

The paper currency 80 moves edgewise over the guide slot 52 and is fed into the space between the positioning plate 50 and the restraining members 86. In this position, the paper currency 80 is disposed upright on its short edge. As the positioning plate 50 moves forward, the paper currency 80 is forced forward by the positioning plate 50 and past the sides of the restraining members 86 where it is aligned with other paper currency that has previously been stacked.

The positioning plate 50 fits in between the two restraining members 86 and causes the currency 80 to bend slightly along its vertical axis so that the currency 80 slides past the sides of the restraining members 86. This same forward movement of the positioning plate 50 causes the previously stacked paper currency, the pressure plate 84 and the foam biasing member 82 to move backward in the currency cassette 60. This movement makes room behind the back edges of the restraining members 86 for the currency 80 to be stacked next to the previously stacked paper currency.

Figure 7:
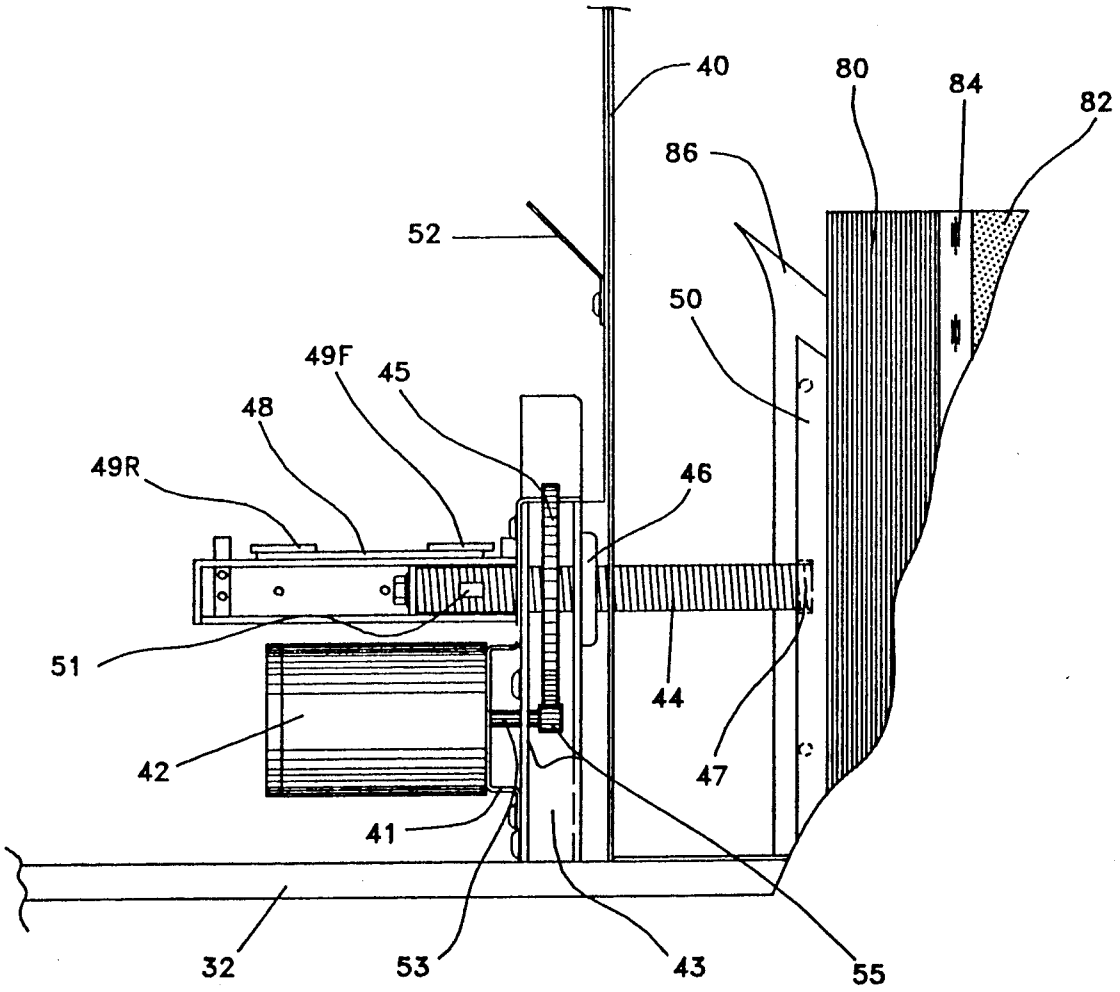
FIG. 7 shows the currency stacker of the present invention with the currency positioning plate in a position after the currency is stacked into the currency cassette.

As the currency 80 clears beyond the back edges of the restraining members 86, the currency 80 unbends back to a flat, upright vertical orientation as shown in FIG. 7. This forward movement of the positioning plate 50 is detected by the forward sensor 49F due to position on the archimedean screw 44 of the magnet 51. When the magnet 51 reaches the forward sensor 49F, a signal is sent to the drive motor 42 to reverse the drive motor 42 to cause the positioning plate 50 to be moved backward to the receiving position shown in FIG. 6. The positioning plate 50 continues to move backward until the location of the magnet 51 on the archimedean screw 44 is sensed by the rear sensor 49, at which time a signal is sent to the drive motor 42 to stop. The system is now ready to receive the next paper currency 80.

The back edges of the restraining members 86 restrain the currency 80 in its aligned position inside the currency cassette 60 and the forward pressure of the foam biasing member 82 keeps the stacked currency in an upright position. As more and more paper currency is fed into the currency cassette 60, the foam biasing member 82 gradually compresses. When the currency cassette 60 is full, the pressure plate 84 will have moved backward in the currency cassette 60 until it reaches a location adjacent the sensor aperture 90. When the sensor located adjacent the sensor aperture 90 senses the position of the pressure plate 84, a signal can be sent to alert personnel that the currency stacker is full and the currency cassette 60 needs to be replaced. For example, a candle can be illuminated on top of the currency stacker 30 indicating the need to replace the currency cassette 60.

When replacing the currency cassette 60, the personnel need only unlock and open the stacker access door 13. The currency stacker 30 can then easily be slid forward so that access to the currency cassette 60 can be had. The currency cassette 60 is removed by lifting on the handle 78 and a new empty currency cassette 60 is placed into the cassette sleeve 40. The currency stacker 30 is then slid back into the lower section 12 and the stacker access door 13 is locked and closed. The full currency cassette 60 can then be taken to a suitable location where its contents can be audited by unlocking and opening the lid 70. This separate locked arrangement of the currency cassette 60 provides the necessary security for handling paper currency.

Figure 8:
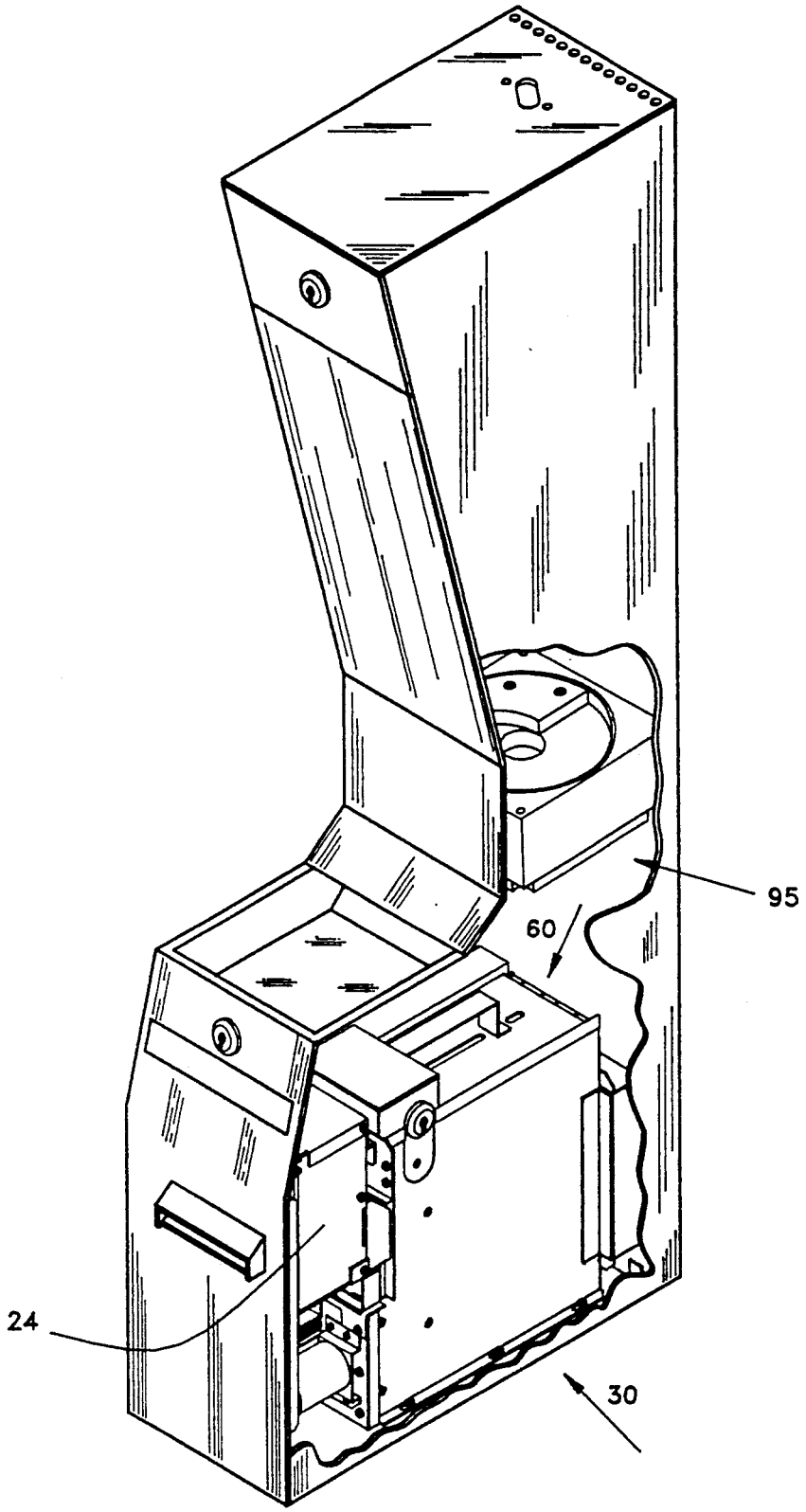
FIG. 8 shows an overall view of the currency handling system of the present invention partially in cutaway showing the relative positions of the currency acceptor, the currency stacker, the currency cassette and the coin feeding device.

At the same time that the currency acceptor 24 is sending electronic signals to the currency stacker 30 to effect the stacking of the paper currency 80, the currency acceptor 24 is also sending an electronic signal to a coin feeding device 95 located in the upper section 11 of the currency handling system 10 as shown in FIG. 8. The coin feeding device 95 located in the upper section 11 can be any suitable coin dispensing mechanism that will deliver the appropriate number of loose coins into the coin tray 16 for access by the user of the currency handling system 10. In the preferred embodiment, the coin feeding device 95 can by the apparatus disclosed in co-pending application Ser. No. 07/645,966, filed Jan. 23, 1991, entitled "Coin Feeding Device," now U.S. Pat. No. 5,098,339, issued Mar. 24, 1992, and currently assigned to the assignee of the instant application. The disclosure of that patent is incorporated herein by this reference thereto.

Figure 9:
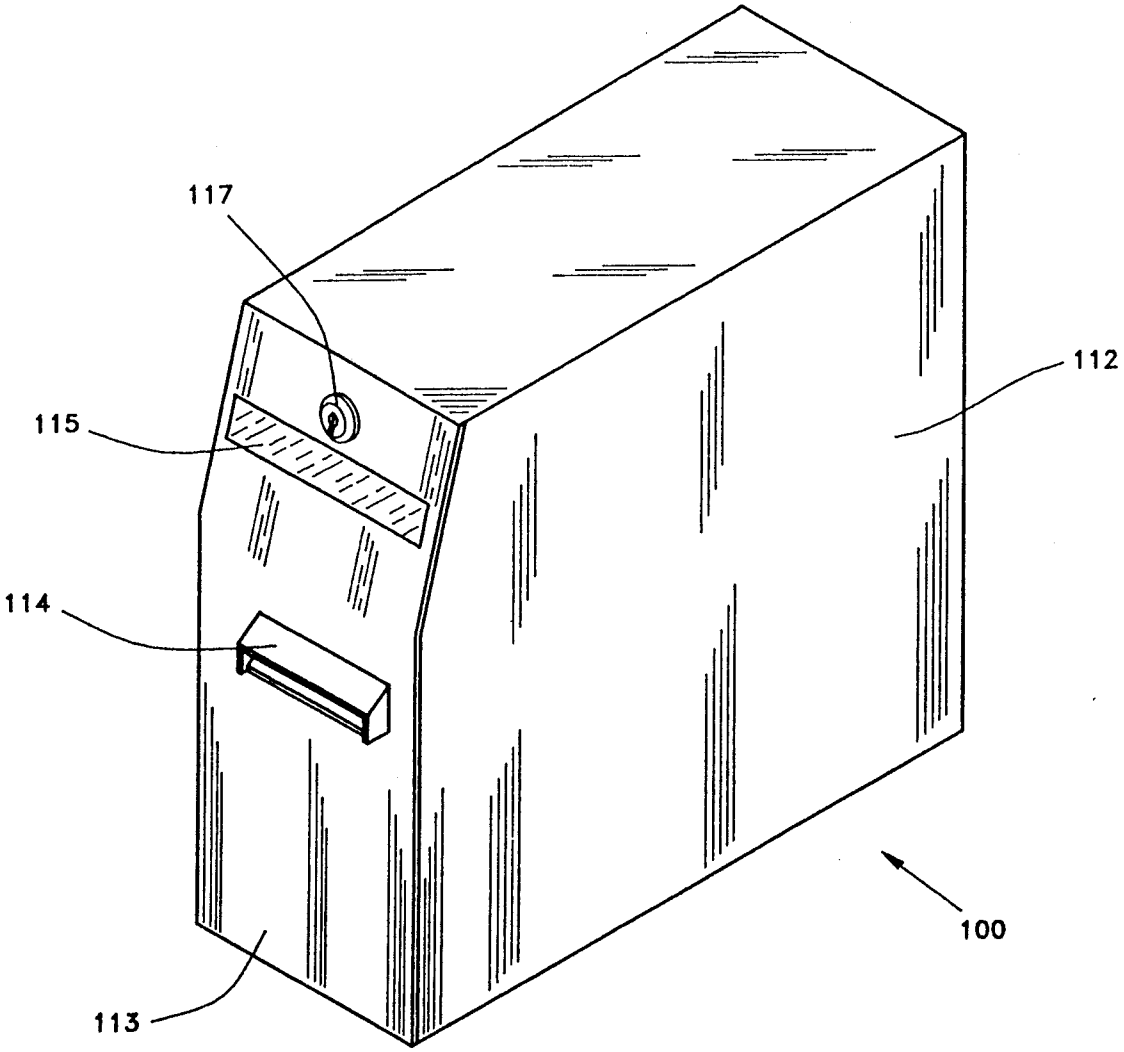
FIG. 9 shows an overall view of a modified version of the currency handling system of the present invention.

FIG. 9 shows an alternate embodiment of the currency handling system of the present invention. The currency handling system currency handling system 100 includes a lower section 112 in which is mounted all of the components of this alternate embodiment. The front of the lower section 112 is provided with a stacker access door 113 that also includes a currency slot 114, a digital display 115 and a lock 117. The top of the lower section 112 is completely closed off since there is no need in this embodiment for a coin tray.

The interior of the lower section 112 contains the currency acceptor 24, the currency stacker 30 and the currency cassette 60 in the same configuration as is shown in FIG. 2 relating to the first embodiment of the present invention. However, instead of being provided with a coin feeding device to dispense loose coin directly for access by the user into a coin tray, the currency handling system 100 is electronically interconnected to a gaming device. When a paper currency is validated by the currency acceptor 24, an electronic signal is sent directly to the credit meter of a gaming device and the value of the paper currency is credited to the amount shown on a credit meter in the gaming device so that the player can operate the gaming device. At the same time that this crediting of the value of the currency is going on, the currency stacker 30 operates to stack the currency in the currency cassette as described above in connection with the previous embodiment.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A currency stacker comprising:

a) a base plate, b) a cassette sleeve mounted to the base plate, c) a drive wheel mounted to the cassette sleeve, an archimedean screw attached to the drive wheel and a positioning plate attached to the archimedean screw, the positioning plate having a generally planar currency engaging surface, d) a currency cassette having a hollow interior removably positioned inside the cassette sleeve, the currency cassette including an archimedean screw slot and a positioning plate slot to receive the positioning plate and the archimedean screw when the currency cassette is loaded into the cassette sleeve, and e) the currency cassette further including a biasing member attached to the interior of the currency cassette, a pressure plate attached to one end of the biasing member and a restraining member attached to the interior of the currency cassette adjacent to the pressure plate whereby as currency is fed into the currency stacker, the currency is stacked in an upright position against the pressure plate and retained in position by the restraining member.

2. The currency stacker of claim 1 wherein the base plate is a generally rectangular plate adapted to be slidably received in a housing of a currency handling system.

3. The currency stacker of claim 1 wherein the cassette sleeve includes a guide slot so that currency can be guided into the currency cassette.

4. The currency stacker of claim 1 wherein the currency cassette includes a lid and a lock whereby the currency cassette can be locked in a closed position.

5. The currency stacker of claim 4 wherein the lid is pivotally attached to the currency cassette.

6. The currency stacker of claim 1 wherein the restraining member includes a pair of spaced apart upright members that secure the currency at its edges in a stacked upright position.

7. A currency stacker comprising:

a) a base plate, b) a cassette sleeve mounted to the base plate, c) a drive wheel mounted to the cassette sleeve, an archimedean screw attached to the drive wheel and a positioning plate attached to the archimedean screw, the archimedean screw having a magnet mounted thereon and a sensor associated therewith so that the relative location of the positioning plate can be determined, and d) a currency cassette having a hollow interior removably positioned inside the cassette sleeve, the currency cassette including a biasing member attached to the interior of the currency cassette, a pressure plate attached to one end of the biasing member and a restraining member attached to the interior of the currency cassette adjacent to the pressure plate whereby as currency is fed into the currency stacker, the currency is stacked in an upright position against the pressure plate and retained in position by the restraining member.

8. A currency handling system enclosed in a housing comprising:

a) a currency stacker comprising:

1) a base plate, 2) a cassette sleeve mounted to the base plate, 3) a drive wheel mounted to the cassette sleeve, an archimedean screw attached to the drive wheel and a positioning plate attached to the archimedean screw, the positioning plate having a generally planar currency engaging surface, 4) the currency cassette including an archimedean screw slot and a positioning plate slot to receive the positioning plate and the archimedean screw when the currency cassette is loaded into the cassette sleeve, and 5) a currency cassette having a hollow interior removably positioned inside the cassette sleeve, the currency cassette further including a biasing member attached to the interior of the currency cassette, a pressure plate attached to one end of the biasing member and a restraining member attached to the interior of the currency cassette adjacent to the pressure plate, and b) a door providing access to the interior of the housing and mounted to the currency stacker, the door including a currency slot and a currency acceptor mounted thereon in operable relation to the currency stacker, whereby as currency is fed into the currency slot, the currency is validated by the currency acceptor and fed to the currency stacker where it is stacked in an upright position against the pressure plate and retained in position by the restraining member.

9. The currency handling system of claim 8 wherein the door is pivotably attached to the base plate and the base plate is slidably received in the housing so that when the door is open, the currency stacker may be slit out of the housing to provide access to the currency cassette.

10. The currency handling system of claim 8 wherein the cassette sleeve includes a guide slot mounted adjacent to the currency acceptor so that currency can be guided into the currency cassette.

11. The currency handling system of claim 8 wherein the currency cassette includes a lid and a lock whereby the currency cassette can be locked in a closed position.

12. The currency handling system of claim 11 wherein the lid is pivotally attached to the currency cassette.

13. The currency handling system of claim 8 wherein the restraining member includes a pair of spaced apart upright members that secure the currency at its edges in a stacked upright position.

14. A currency handling system comprising:

a) a lower section having:

1) a currency stacker comprising:

(A) a base plate, (B) a cassette sleeve mounted to the base plate, (C) a drive wheel mounted to the cassette sleeve, an archimedean screw attached to the drive wheel and a positioning plate attached to the archimedean screw, the positioning plate having a generally planar currency engaging surface, (D) the currency cassette including an archimedean screw slot and a positioning plate slot to receive the positioning plate and the archimedean screw when the currency cassette is loaded into the cassette sleeve, and (E) a currency cassette having a hollow interior removably positioned inside the cassette sleeve, the currency cassette further including a biasing member attached to the interior of the currency cassette, a pressure plate attached to one end of the biasing member and a restraining member attached to the interior of the currency cassette adjacent to the pressure plate, 2) a door mounted to the currency stacker, the door including a currency slot and a currency acceptor mounted thereon in operable relation to the currency stacker, and 3) a coin tray mounted in the lower section, and b) an upper section having a coin feeding device mounted in operable relation to the coin tray whereby as currency is fed into the currency slot, the currency is validated by the currency acceptor and fed to the currency stacker where it is stacked in an upright position against the pressure plate and retained in position by the restraining member and coinage from the coin feeding device is dispensed into the coin tray for access by a user of the currency handling system.

15. The currency handling system of claim 14 wherein the door is pivotably attached to the base plate and the base plate is slidably received in the housing so that when the door is open, the currency stacker may be slid out of the housing to provide access to the currency cassette.

16. The currency handling system of claim 14 wherein the cassette sleeve includes a guide slot mounted adjacent to the currency adaptor so that currency can be guided into the currency cassette.

17. The currency handling system of claim 14 wherein the currency cassette includes a lid and a lock whereby the currency cassette can be locked in a closed position.

18. The currency handling system of claim 17 wherein the lid is pivotally attached to the currency cassette.

19. The currency handling system of claim 14 wherein the restraining member includes a pair of spaced apart upright members that secure the currency at its edges in a stacked upright position.

* * * * *